US006395135B1

(12) United States Patent
Kojo et al.

(10) Patent No.: US 6,395,135 B1
(45) Date of Patent: May 28, 2002

(54) METHOD AND APPARATUS FOR THREADING OF PAPER OR PAPERBOARD WEB

(75) Inventors: Teppo Kojo, Mäntsälä ; Mika Tammenoja, Palokka; Harri Mustonen, Jyväskylä, all of (FI)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 09/937,253

(22) PCT Filed: Mar. 21, 2000

(86) PCT No.: PCT/FI00/00229

§ 371 (c)(1),
(2), (4) Date: Sep. 19, 2001

(87) PCT Pub. No.: WO00/60166

PCT Pub. Date: Oct. 12, 2000

(30) Foreign Application Priority Data

Mar. 23, 1999 (FI) ..... 990651

(51) Int. Cl.[7] ..... D21F 7/00
(52) U.S. Cl. ..... 162/193; 162/255
(58) Field of Search ..... 162/193, 194, 162/255; 226/91, 92, 118.2, 195

(56) References Cited

U.S. PATENT DOCUMENTS

| | | | | |
|---|---|---|---|---|
| 3,779,074 A | | 12/1973 | Breyer | 73/144 |
| 3,784,123 A | | 1/1974 | Lewis | 242/75.53 |
| 4,014,740 A | | 3/1977 | Koponen et al. | 162/289 |
| 4,429,819 A | | 2/1984 | Palivaara | 226/95 |
| 4,501,643 A | | 2/1985 | Kiuru | 162/286 |
| 4,566,944 A | | 1/1986 | Mauranen et al. | 162/286 |
| 4,692,215 A | | 9/1987 | Kerttula | 162/289 |
| 4,838,498 A | | 6/1989 | Huth | 42/75.51 |
| 4,998,427 A | * | 3/1991 | Peterson et al. | 72/9 |
| 5,052,233 A | * | 10/1991 | Rantala | 73/862.45 |
| 5,164,710 A | * | 11/1992 | Anderegg et al. | 340/677 |
| 6,235,156 B1 | * | 5/2001 | Pullinen et al. | |

OTHER PUBLICATIONS

"Driving Ahead in the Paper Industry;" Worland, Peter; PPI: Pulp & Paper International v40n 12; pp. 40–45; Dec. 1998.

* cited by examiner

*Primary Examiner*—Dean T. Nguyen
(74) *Attorney, Agent, or Firm*—Steinberg & Raskin, P.C.

(57) ABSTRACT

In the method for threading of a paper or paperboard web a narrower tail (T) separated from the paper or paperboard web (W) is conveyed between different holding points. On the travel path of the tail (T) there is at least one tension measuring device (1) which is arranged to measure the tension of the tail (T) passing by, said device (1) being connected to a data processing unit (7) which is connected to tension control means affecting the tail (T). The threading can be conducted on a tension level lower than the actual running tension of the full-width web (W).

11 Claims, 2 Drawing Sheets

METHOD AND APPARATUS FOR THREADING OF PAPER OR PAPERBOARD WEB

FIELD OF THE INVENTION

The invention relates to a method for threading of paper or paperboard web which is of the type in which a narrow tail section separated from the paper or paperboard web (W) is conveyed between first and second holding points. The invention also relates to a threading apparatus for threading a paper or paperboard web which is adapted to guide a tail section separated from the paper or paper board web (W).

BACKGROUND OF THE INVENTION

In present paper/paperboard machines the threading is conducted by cutting a narrower tail or lead-in strip from the edge of a web. This tail is conveyed through the machine all the way to the reel-up by means of threading devices (e.g. blowing plates, ropes or a suction belt). The tail can also be separated from a point closer to the middle of the web, by a so-called dual cutting. All methods, irrespective of the cutting point, share the same principle that the paper is first passed in the form of a narrower tail whereafter it is spread to form a fall-width web. The threading takes place one portion at a time, if there are free draws in the machine, wherein the tail is passed in w the form of a narrow strip to a predetermined holding point, whereafter the web is spread into the full width. From the holding point a narrow strip is conveyed to the following holding point. In this manner it is possible to conduct the threading in short sections from the press all the way to the reel-up via the drying section, wherein the distance does not grow too long and the web can still be controlled easily.

Different devices for cutting off and controlling the tail are disclosed for example in the FI patent 62695 (corresponding U.S. Pat. No. 4,501,643), U.S. Pat. No. 4,692,215, U.S. Pat. No. 4014740, FI patent 63800 (corresponding U.S. Pat. No. 4,566,944) and in the FI patent 59833 (corresponding U.S. Pat. No. 4,429,819).

Threading is most problematic along so-called free runs in which the tail/web is not supported over its entire travel path. For example in a paper web the threading from the drying section through a machine calender or a soft calender all the way to the reel-up contains relatively long free runs. In the free runs the travel of the tail from one holding point to another (e.g. calender nip—reel-up nip) is controlled by means of a speed difference i.e. draw difference between the points in such a manner that the latter nip in the travel direction of the tail/web has a higher speed, wherein a sufficient difference keeps the tail tight. It is a problem of this so-called speed control that it is independent of the web and its properties. Generally, the speed difference is adjusted manually by the persons operating the machine on the basis of a visual conception of the tension of the web/tail. Often the changes in the speed difference become quite substantial and they occur rapidly, wherein the risk of tail/web break is increased and production time is lost.

It is an aim of the invention to introduce a method and an apparatus by means of which the threading of paper or paperboard web can be conducted in a more reliable manner and the risk of web break is decreased.

The idea of the invention is to conduct threading in the free runs by means of tension control, wherein the runnability/tension of the strip and the subwide web can be adjusted, when necessary, within the limits of the strength of the same, thereby avoiding unnecessary breaks.

The apparatus according to the invention is characterized in what will be presented in the characterizing part of the appended claim 9.

There are known devices for measuring the web tension profile, by means of which it is possible to measure the tension profile of a full-width web during the run. This technique can also be applied in the tension control along the free run by measuring the web tension from a tail which is narrower that the full-width web. Thus, it is possible to calculate an average value from local measurement points, which average value is used as a measurement value of the tension control. The threading can also be conducted within the limits of local tension values (min and max), if necessary.

BRIEF DESCRIPTION OF THE DRAWINGS

In the following, the invention will be described in more detail with reference to the appended drawings in which.

DETAILED DESCRIPTION OF THE INVENTION

Figure 1:
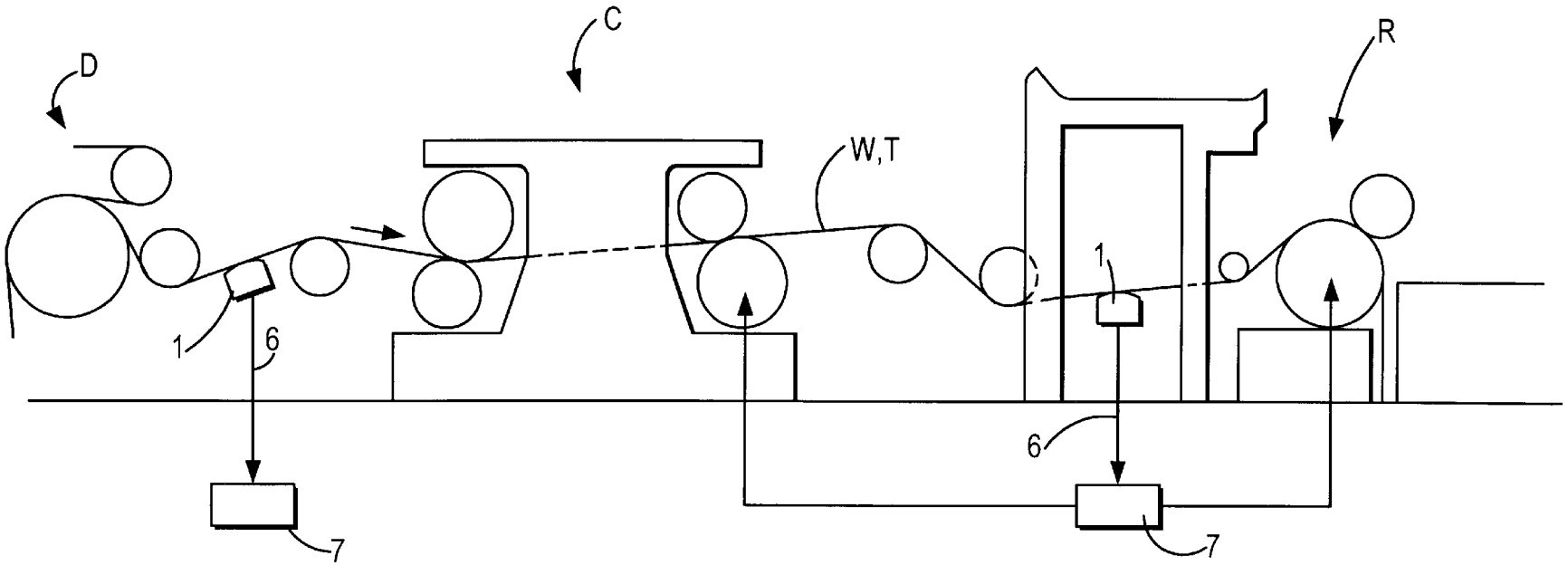
FIG. 1 shows a side-view of the apparatus.

FIG. 1 shows a side-view of an apparatus placed on a section of the paper or paperboard machine. FIG. 1 shows a typical section of a paper or paperboard machine containing free runs in which section the web travels from the drying section D through a calender C, in this case a 2-nip soft calender, to the reel-up R. On the travel path of the paper or paperboard web there is a suitable number of measuring devices 1, which are arranged to measure web tension at least from the tail which is narrower than the full-width web W. The tail is a part having usually a width of 50 cm maximum, separated from the edge of a full-width web or from the middle of the same by means of a cutting method, said part being first guided via the machine portion following the cutting point before it is spread to form a full-width web. In this application attention is not paid to the cutting and guiding methods of the tail, in which it is possible to apply solutions well known in the field.

The measuring devices 1 continuously measure the web tension from the tail passing by in accordance with the on-line principle. The measurement device 1 is connected to a data processing unit 7 which contains information given by the measuring device, conducts a comparison with a predetermined target value and controls the control means affecting the tension, especially to adjust the effect of the holding points located before and after the measuring device 1. Thus, it is possible to control for example the speed difference or torque difference between the holding points, i.e. such factors by means of which tension can be attained in the tail. In practice, it is sufficient to control the speed or torque of the latter holding point, i.e. the holding point located after the measuring point in the travel direction of the web, if the values of the preceding holding point are kept constant. The holding point may be formed in the nip between a roll guiding the travel path of the web and another member positioned against the same, such as a second roll. In FIG. 1, the speed difference between the nip of the calender C and the reel-up R is thus controlled. The holding point can, however, be a moving member of another type which is in contact with the tail and by means of which it is possible to attain traction on the tail, for example a moving suction belt acting as the threading device which conveys the belt forward and to the surface of which the tail adheres by means of negative pressure effective through the belt. The speed of such belt can be adjusted to control the tension. Similarly, the holding point can be a threading device 6f another type, such as threading ropes, belts, or the like, the speed of which can be adjusted to affect the tension.

Figure 2:
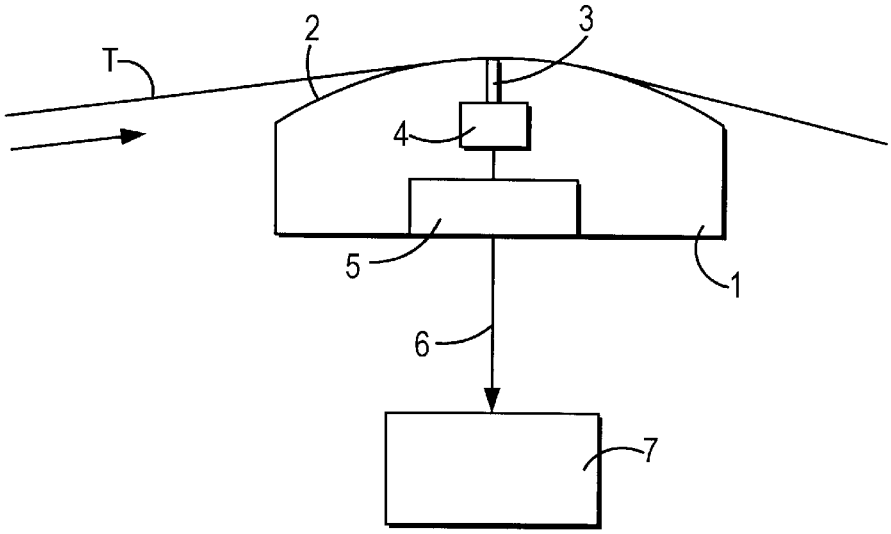
FIG. 2 shows the operating principle of the measurement device used in the apparatus.

FIG. 2 schematically illustrates the measurement principle. The method utilizes the principle of measuring a floating pressure which is known from the tension profile meter of the web and presented in the publication U.S. Pat. No. 5,052,233. When the tail T is guided over the curved, solid surface of the measuring device 1, the air conveyed by the tail produces an air cushion between the tail and the measuring device 1. This pressure can be measured by means of measurement orifices 3 opening on the surface.

Inside the device 1, there is a pressure transducer 4 connected to the pressure of the cushion, which is proportional to the tension and is transmitted via the measurement orifice 3. The pressure transducer 4 is connected to control electronics 5 to transmit an electric signal pro portional to the pressure along a line 6 to the data processing unit 7. By means of the data processing unit 7 it is possible to control the arrival of signals from different points which correspond to the different orifices 3 and transducers 4. The data processing unit 7 processes the tension information to set an optimal draw difference in the portion where the measuring device 1 is located. The measurement orifices 3 are aligned at the tail T in the cross direction by the tail within a suitable spacing.

Figure 3:
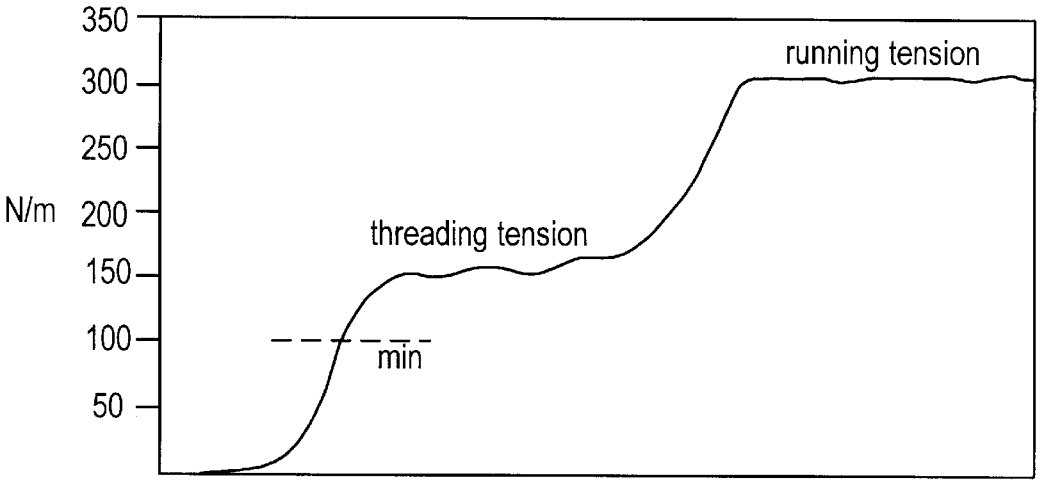
FIG. 3 is a graph showing web tension in different stages of the method.

When the tail has been transferred over the open portion in which the measuring device 1 is located, it is possible to switch the drive responsible for the speed control of the portion over to tension control according to the result of the tension measurement of the tail T. FIG. 3 shows one possible method as a graph. The switching over to the tension control mode can take place starting from that moment when the measuring device 1 detects the web tension of the tail T that exceeds a given minimum value, i.e. a threshold value of the web tension (broken line "min" in the graph). This predetermined value depends on the strength of the paper/paperboard grade in question so that the switching takes place within the limits set by the strength of the tail, and breaking of the tail does not occur. In the tension control, the tension of the tail T is maintained in the given set value, or within a given range.

The drive of the holding point following the measurement point, e.g. the drive of the reeling cylinder, remains in the tension adjustment mode, which is its normal way of operation. When the tail T has travelled under the control of the threading tension for a while, the web can be spread in a known manner by means of diagonal cutting, whereafter the production run of the full-width web can be started. FIG. 3 shows a manner in which the threading tension can be controlled, according to which a separate threading tension level is used which is lower than the tension of the production run, thereby ensuring a successful threading because the quality of the web does not yet necessarily equal that required by continuous run at this stage, and according to FIG. 3, the last stage involves ramping up to the actual web tension after the act of spreading the web into its full width. According to FIG. 3, the threading tension is approximately 150 N/m and the running tension approximately 300 N/m, but these values are only examples and the values used in each situation depend on the paper or paperboard grade.

By means of the method in question it is possible to facilitate for example ropeless threading by adjusting the tension of the tail and later on the tension of the web to an optimal level within the respective portion. The invention is not, however, restricted only to the ropeless threading, but it can also be utilized in connection with threading ropes or other threading members intended especially for threading. By means of these the tail is passed to the following holding point, leased from the ropes, and the travel of the tail is stabilized in a similar manner as described above.

In principle, the measuring device has to be located only in the area of the tail T in the cross direction, i.e. only within a section of the travel path of the full-width web. The measuring device, however, can be a full-width measuring beam, wherein it can be used to measure the average tension and tension profile during the run, and only the measurement orifices 3 and corresponding transducers 4 by the location of the tail T are used when the tension of the tail is measured.

The invention is not restricted to the tension measurement principle presented in the embodiments, but it can be modified within the inventive idea presented in the claims. Similarly, in addition to a paper or paperboard machine the method is suitable to be used in all treatment machines for web, in which a narrower threading tail is conveyed along a given path before the passing of a full-width paper or paperboard web, for example in finishing machines, such as coating machines.

What is claimed is:

1. Method for threading of a paper or paperboard web in which a narrower tail (T) separated from the paper or paperboard web (W) is conveyed between different holding points, comprising the steps of:

measuring a tension value of the tail (T) by means of a tension measuring device during a run of said tail, and using said measured tension value of the tail (T) to control a threading of said tail.

2. Method according to claim 1, wherein the threading is controlled on the basis of the tension value by controlling the effect of different holding points on the tail (T).

3. Method according to claim 2, wherein the tension value is utilized to control one of the speed difference and the torque difference between the holding points.

4. Method according to claim 2, wherein the effect of a nip between a roll and another member located against the roll on the tail (T), such as the nip of a reel-up (R), is controlled.

5. Method according to claim 2, wherein the effect of a threading device on the tail (T) is controlled.

6. Method according to claim 1, wherein the control is started when the tension value measured by the measuring device (1) exceeds a given minimum value.

7. Method according to claim 1, wherein the tension is measured by means of pressure of air conveyed by the tail (T).

8. Method according to claim 1, wherein the threading is conducted on a tension level lower than the actual running tension of the full-width web (W).

9. Apparatus for threading a paper or paperboard web comprising:

means for guiding a narrower tail (T) separated from a paper or paperboard web, at least one tension measuring device (1) placed on the travel path of the tail (T), which is arranged to measure the tension of the tail (T) passing by, a data processing unit (7) operably connected to said tension measuring device, tension control means for controlling the tension of the tail (T), said tension control means being operably connected to said data processing unit (7).

10. Apparatus according to claim 9, wherein the data processing unit (7) is connected to a speed control device of the tail.

11. Apparatus according to claim 9, wherein the tension measuring device (1) is a device measuring the pressure of an air cushion between the tail (T) and a surface (2) Stationary with respect to the tail.

* * * * *

UNITED STATES PATENT AND TRADEMARK OFFICE

CERTIFICATE OF CORRECTION

PATENT NO. : 6,395,135 B1
DATED : May 28, 2002
INVENTOR(S) : Kojo et al.

It is certified that error appears in the above-identified patent and that said Letters Patent is hereby corrected as shown below:

Title page,
Item [86], the 371 date should read -- September 24, 2001 --

Signed and Sealed this

Sixteenth Day of October, 2002

*Attest:*

*Attesting Officer*

JAMES E. ROGAN
*Director of the United States Patent and Trademark Office*